US007573701B2

(12) United States Patent
Doberstein et al.

(10) Patent No.: US 7,573,701 B2
(45) Date of Patent: Aug. 11, 2009

(54) ELECTRONIC CONTROL MOUNT WITH SWITCH SUPPORT AND LIGHT GUIDE

(75) Inventors: Andrew J. Doberstein, Hartford, WI (US); Joseph H. Zyduck, Mukwonago, WI (US)

(73) Assignee: U-Line Corporation, Milwaukee, WI (US)

( * ) Notice: Subject to any disclaimer, the term of this patent is extended or adjusted under 35 U.S.C. 154(b) by 358 days.

(21) Appl. No.: 11/535,826

(22) Filed: Sep. 27, 2006

(65) Prior Publication Data

US 2008/0130203 A1 Jun. 5, 2008

Related U.S. Application Data

(60) Provisional application No. 60/823,961, filed on Aug. 30, 2006.

(51) Int. Cl.
*H05K 5/00* (2006.01)

(52) U.S. Cl. ..... 361/679.01; 361/601; 236/94

(58) Field of Classification Search ..... 361/679, 361/601, 825, 679.01; 349/58; 236/94
See application file for complete search history.

(56) References Cited

U.S. PATENT DOCUMENTS

| | | | | |
|---|---|---|---|---|
| 4,404,522 | A * | 9/1983 | Pucciarello | 324/114 |
| 5,455,743 | A * | 10/1995 | Miyajima | 361/781 |
| 5,662,213 | A * | 9/1997 | Kattler et al. | 200/302.3 |
| 5,867,235 | A * | 2/1999 | Hasegawa | 349/58 |
| 7,140,551 | B2 * | 11/2006 | de Pauw et al. | 236/94 |
| 2006/0021363 | A1 * | 2/2006 | Mizukoshi | 62/129 |
| 2006/0218958 | A1 | 10/2006 | Rand et al. | |

* cited by examiner

*Primary Examiner*—Michael C Zarroli
(74) *Attorney, Agent, or Firm*—Quarles & Brady LLP

(57) ABSTRACT

A control assembly for a compact refrigeration unit and the like includes a display panel, a control board having an LED and a switch pad, a flexible extension extending between the switch and the display panel, and a mount supporting the display panel and control board and having a switch support laterally restraining the flexible extension and an open ended light guide directing light from the LED to the display panel. The mount can be a monolithic structure having a switch support and light guide for each of multiple switches and LEDs. The mount includes a removable back cover that clamps the control board in place.

20 Claims, 11 Drawing Sheets

FIG. 1
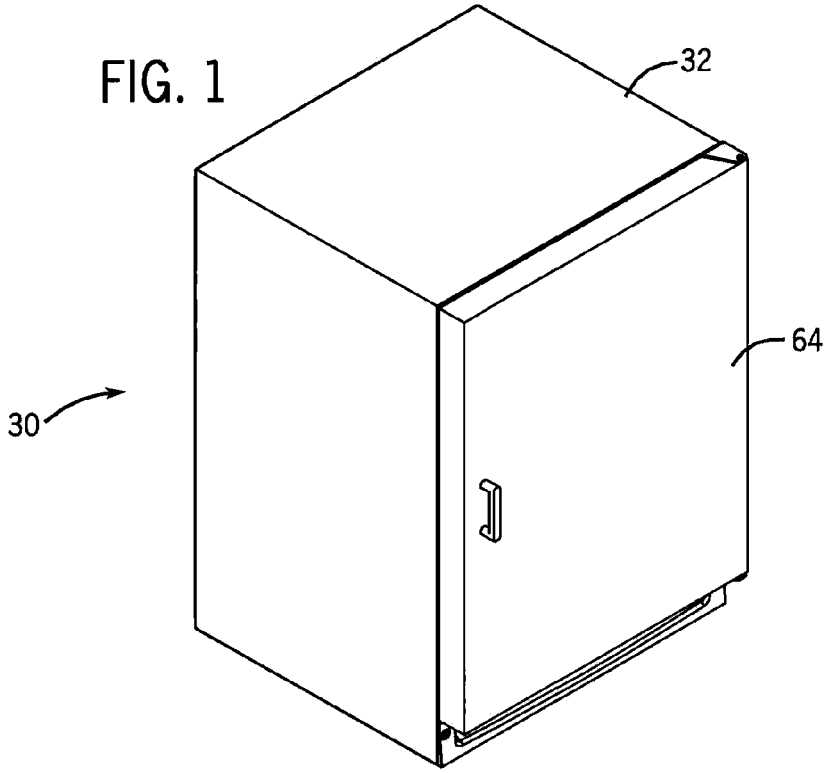
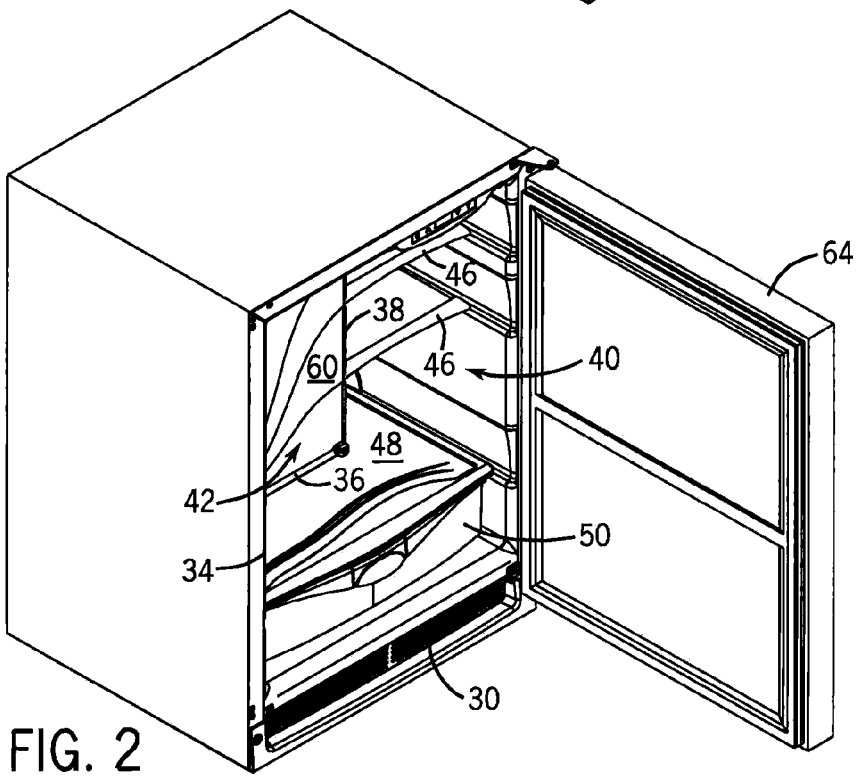
FIG. 2

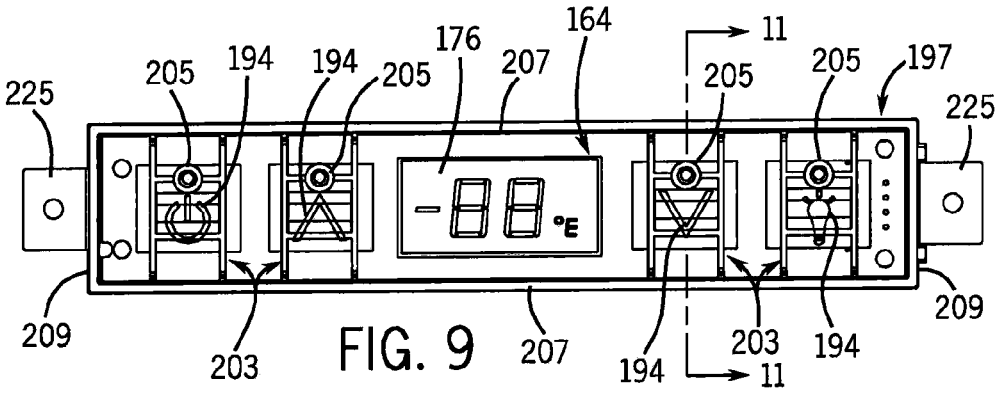
FIG. 9
FIG. 11
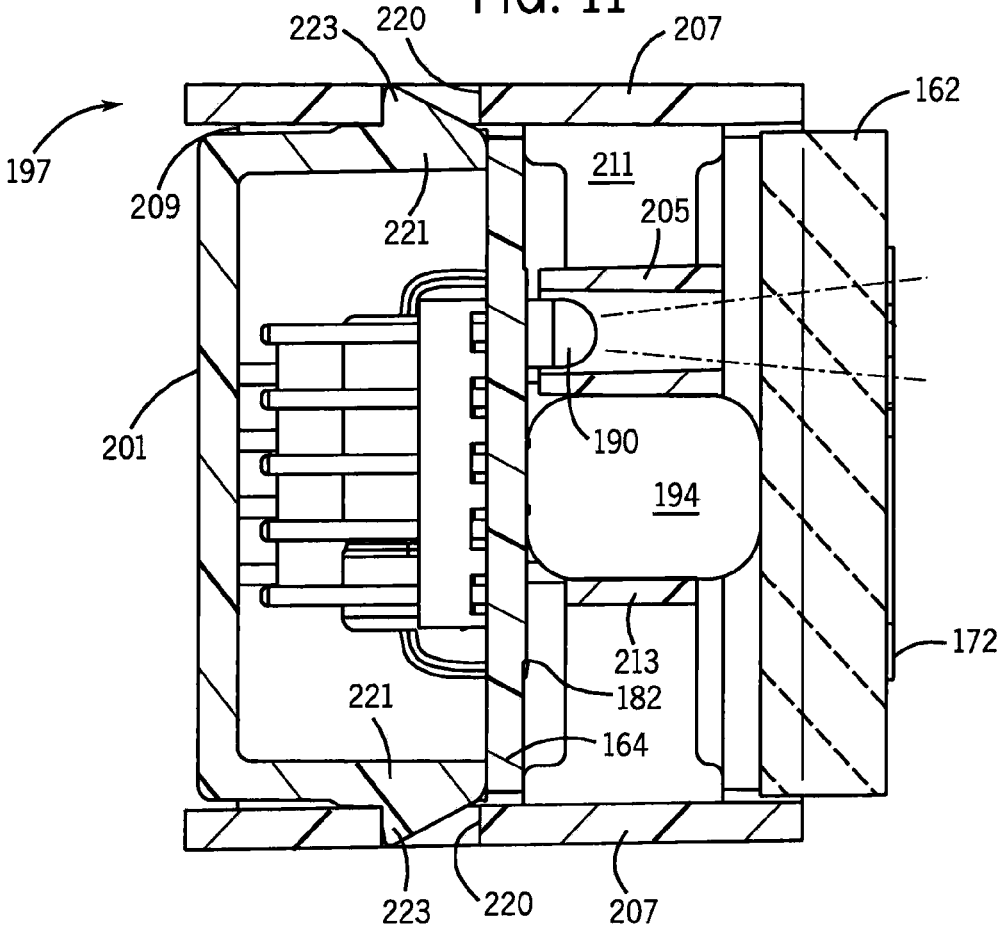

210

208

| INPUT COMMAND | HOLD | TOUCH |
|---|---|---|
| VIEW ACTUAL TEMPERATURE (T1) | ∧ 202 | |
| VIEW ACTUAL TEMPERATURE (T2–T4) | ∧ ∨ 204 | |
| TOGGLE F – C | 206 | ∨ ∨ ∨ |
| TOGGLE SHOWROOM MODE | ∨ | |
| SERVICE MODE | ∧ | |
| DISPLAY TOGGLE | ∧ | |
| BLACKOUT MODE | | |
| CLEAN CYCLE | 200 | |
| ICEMAKER OFF MODE | | ∧ ∧ ∧ |
| FORCED HARVEST | | ∨ ∨ ∨ |
| FORCED REFRIGERATOR DEFROST | | |
| ICE THICKNESS ADJUSTMENT | ∧ | ∨ ∨ ∨ |
| TEMPORARY SHUTDOWN (OFFICE MODE) | ∨ | ∧ ∧ ∧ |
| RELAY STATUS | ∨ | |
| CHANGE MODEL NUMBER (WITH JUMPER) | ∧ ∨ | |

FIG. 14

ELECTRONIC CONTROL MOUNT WITH SWITCH SUPPORT AND LIGHT GUIDE

CROSS-REFERENCE TO RELATED APPLICATION

This application claims the benefit of U.S. Provisional patent application Ser. No. 60/823,961 filed on Aug. 30, 2006, and entitled "Cooling Unit," hereby incorporated by reference as if fully set forth herein.

STATEMENT OF FEDERALLY SPONSORED RESEARCH OR DEVELOPMENT

Not applicable.

BACKGROUND OF THE INVENTION

1. Technical Field

The present invention relates to refrigerated food and drink storage units, and in particular, to the control assembly therefore, and even more particularly to the mounting arrangement for the control board and display panel.

2. Description of the Related Art

Refrigerators and coolers for the cold storage of food and beverages are well known and can come in full-size standup units or compact, under-cabinet units. Modern unit typically have electronic controls for setting and regulating interior temperatures as well as for controlling ancillary features such as lighting, ice making and system monitoring functions.

Such controls are typically mounted inside the cabinet at a location attempting to make the user interface (control buttons, displays, etc) readily accessible and visible to the consumer. However, it is often the case the control interface is not user-friendly for the consumer.

One problem with controls having a display or illuminated buttons is to provide the proper lighting so that the display and/or buttons can be viewed easily. This can be simply a matter of selecting the appropriate level of cabinet lighting and/or selecting a suitably intense display component, such as an LCD or otherwise. However, it is often desired for to illuminate indicate engraved, embossed or printed on a glass panel with a back light. These illuminated "buttons" or "touch pads" provide an aesthetically pleasing interface and are readily visible when properly illuminated.

More and more, light emitting diodes (LEDs) are used for this application because of their small size and low cost. Yet, it is important that the LEDs be positioned in the correctly in proximity to the display panel so that the proper amount of light is directed to the "button" so that it is properly illuminated. In correct positioning can lead to no or inadequate illumination or to the LED being visible to the consumer. And, when multiple "buttons" or in close proximity to one another, it is import that light for one does not corrupt that of another in color, intensity or otherwise. Proper positioning of the LEDs can thus make assembly of the control cumbersome and costly.

Another problem that arises with control interfaces of this type pertains to the activation of the button, which is usually achieved using a capacitive sensor triggered by a change in local capacitance or reaching a threshold capacitance at the location display panel. The display panel is typically glass or other non-electrically conductive material. The sensor is mounted to the control board behind the display panel. Thus, much like the LEDs, it is important for the sensor to be located properly in proximity to the button area of the display panel, especially when there are multiple "buttons" close together. Manufacturing and assembly is thus further complicated.

Accordingly, a control assembly and arrangement for mounting the control board and display panel is needed.

SUMMARY OF THE INVENTION

The present invention addresses the aforementioned problems and provides an improved control assembly and mount therefor.

Specifically, in one aspect the invention provides a mount for an electronic control having a display panel and a control board with an LED and a switch having a flexible extension extending to the display panel. The mount includes a housing for containing the board. The housing has two sets of spaced apart opposite walls extending about the board and defining an open side opening to the display panel. A switch support is disposed in the housing so as to laterally restrain the flexible extension. A light guide is disposed in the housing so as to be adjacent the LED and direct light from the LED to the display panel.

There can be a plurality of switch supports associated with a plurality of switches of the control board, and there can be a plurality of light guides associated with a plurality of LEDs. The mount can also be a monolithic structure, such as a single molded plastic piece, including the housing, one or more of the switch supports and one or more of the light guides as a single unitary piece. The mount can also have a back cover removably connected to the housing that clamps the control board against the switch support(s) and/or the light guide(s). One or more tabs on the back cover can fit into the housing and apply a clamping force on the control board. One or more of tabs can also be used to connect the back cover to the housing via a tab and slot connection. The back cover, or the housing, can have mounting tabs for securing the mount to a mounting surface.

The switch supports can have a pair of bridge walls extending between opposite walls of the housing and a pair of cross walls extending between the bridge walls so as to define an opening therebetween in which the flexible switch extensions fit. The switch supports thus restrain lateral movement of the extensions and ensure that the extension extend from the control board and contact the display panel.

The light guides can be a cylindrical wall, tubular structure or any other suitable configuration having open ends and defining a bounded pathway between the open ends so as to better guide the light from the LEDs to a particular location of the display panel, such as to illuminate a button indicia area of the display panel.

The housing walls can extend to a first plane at the open side of the housing and the switch supports and the light guides can extend to a second plane recessed within the housing from the first plane. This allows the switch supports and light guides to provide a back stop for the display panel, which can be recess fit inside the outer walls of the housing. Also, the switch supports can extend between the second plane and a third plane, and the light guides can extend between the second plane and a fourth plane spaced from the second plane a greater distance than the third plane. This allows the light guides to contact the control board surface, rather than the switch supports, to better ensure that the LED light is captured and directed by the light guides without light passing around the light guides and inside of the housing.

In another aspect the present invention provides a control assembly including a display panel, a control board with an LED and a switch, a flexible extension extending between the switch and the display panel, and a mount supporting the display panel and the control board and having a switch support laterally restraining the flexible extension and an open ended light guide directing light from the LED to the display panel. The assembly components can take the various forms and include the additional structure mentioned above.

The switch extensions can be conductive fabric encased foam structures that provide a conductive path between the metallic pad of a capacitive sensor on the control board and the display panel. The resilience and compressibility of the foam provides a force biasing the conductive fabric in abutment with the display panel without strict tolerances of the control board and display panel assembly.

These and still other advantages of the invention will be apparent from the detailed description and drawings. What follows is a preferred embodiment of the present invention. To assess the full scope of the invention the claims should be looked to as the preferred embodiment is not intended as the only embodiment within the scope of the invention.

BRIEF DESCRIPTION OF THE DRAWINGS

FIG. 1 is a perspective view of a combination refrigerator/freezer unit having the features of the present invention;

FIG. 2 is a perspective view thereof similar to FIG. 1 albeit with its cabinet door open so that the interior of the cabinet is visible;

FIG. 9 is a front elevational view of the control board and mount thereof;

FIG. 11 is a sectional view taken along line 11-11 of FIG. 9;

FIG. 14 is a table of input codes for the user interface control unit.

DETAILED DESCRIPTION OF THE PREFERRED EMBODIMENT

Figure 3:
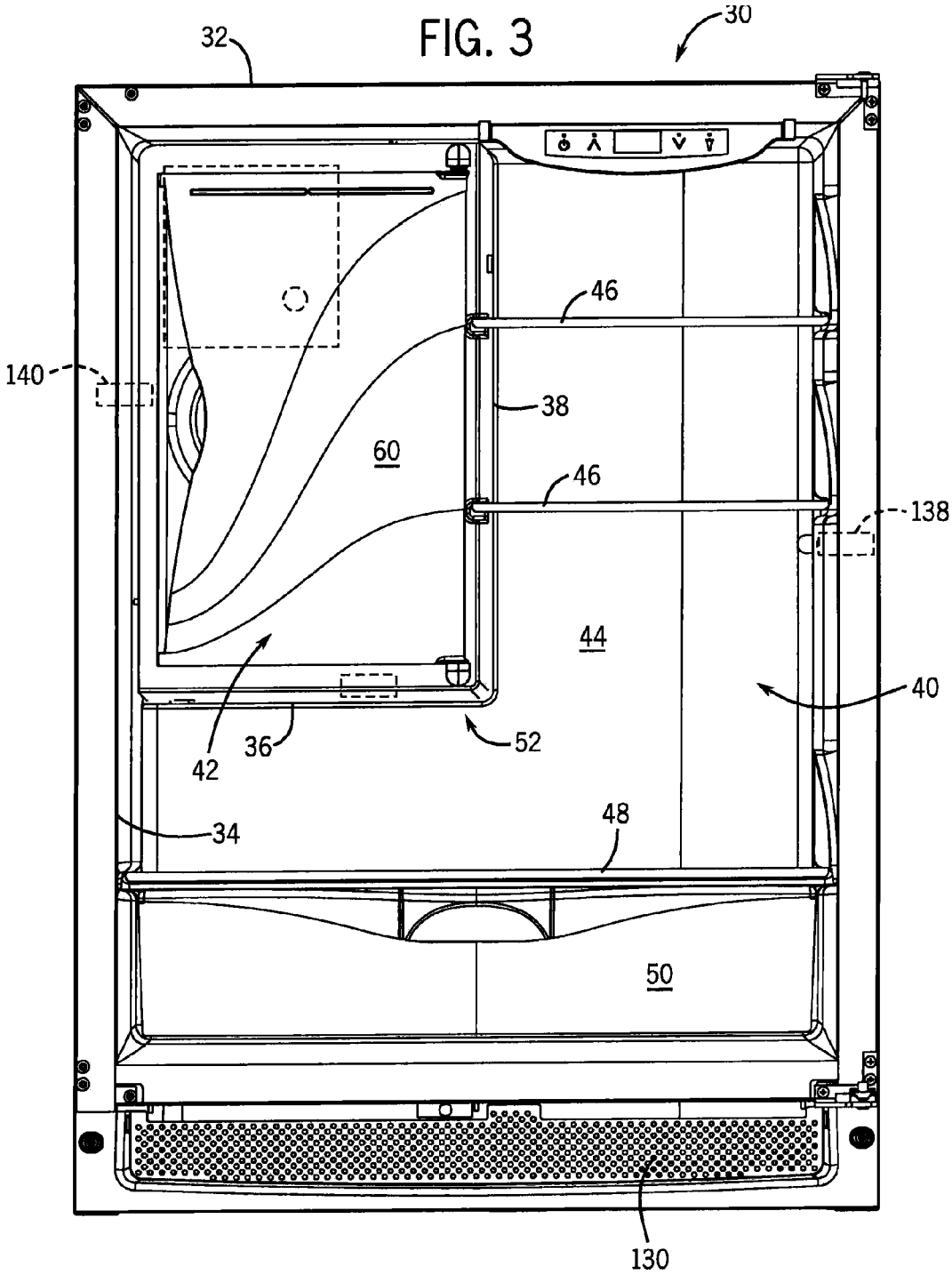
FIG. 3 is a front elevation view thereof with the cabinet door removed.

Referring to FIGS. 1-4, in one preferred form, a combination refrigerator/freezer unit 30 includes a cabinet 32 defining a cavity with a forward opening 34 that is divided by horizontal and vertical partition walls 36 and 38, respectively, into a refrigerator section 40 and an ice section 42. The refrigerator section 40 is an L-shaped chamber having a molded insert liner 44 with grooves that support shelves 46 (two are shown in the drawings). The shelves 46 are supported by corresponding grooves formed in the vertical partition wall 38. Molded insert liner 44 includes a pair of grooves that support a lower support shelf 48 and defines a recess for a crisper drawer 50. The ice section 42 is a rectangular chamber having a foam insulated, molded insert 52 containing a cube ice maker assembly 56 and an ice storage bin 58. The ice section 42 is closed by a door 60 that is hinged to insert 52 along one vertical side thereof. The cabinet opening 34 is closed by a door 64 that is hinged to the cabinet 32 (with self-closing cams) along one vertical side thereof. Both the cabinet 32 and the door 64 are formed of inner molded plastic members and outer formed metal members with the space filled in with an insulating layer of foam material, all of which is well known in the art. The door 64 has a handle (not shown) and can include one or more door shelves.

Figure 4:
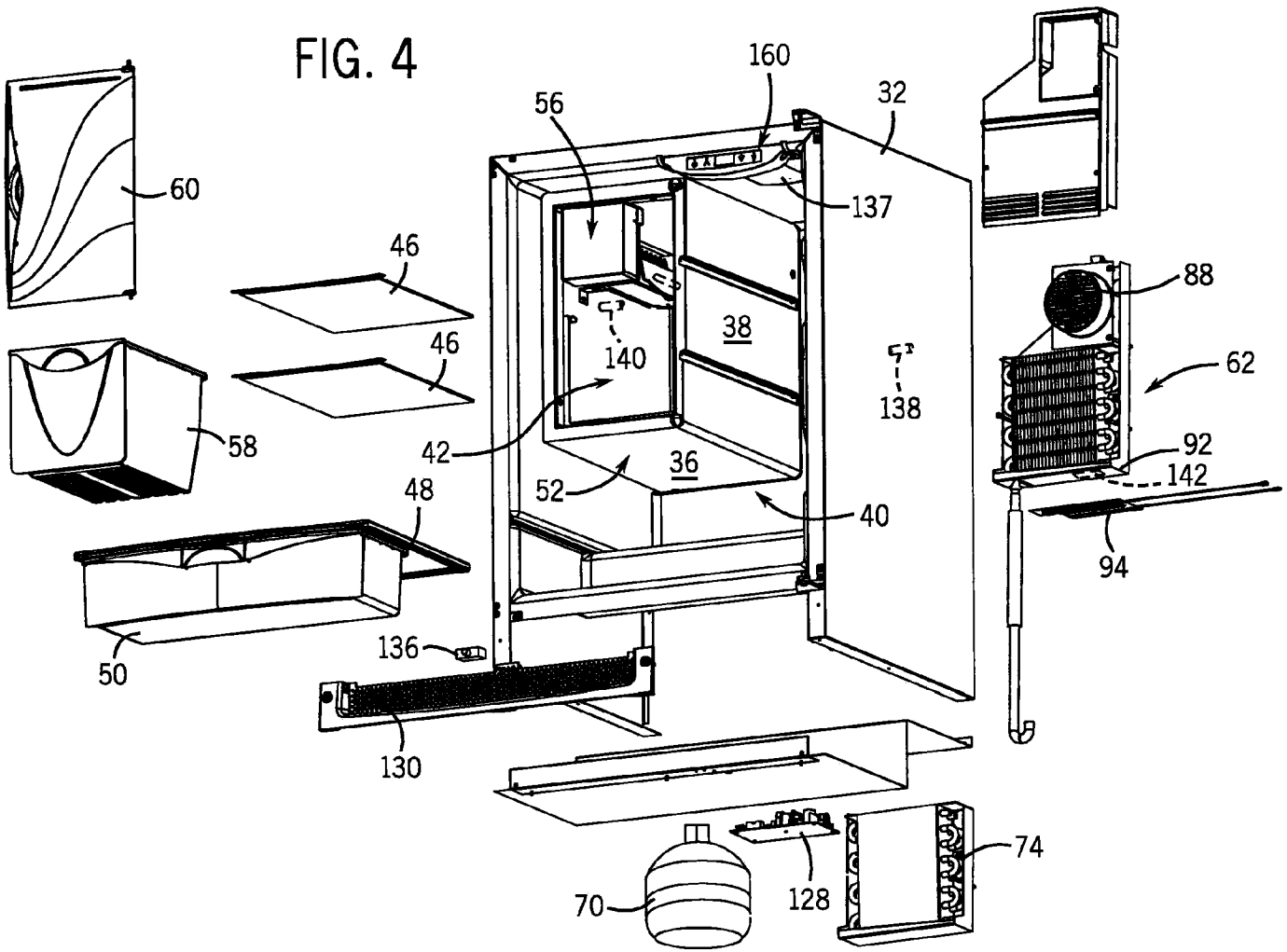
FIG. 4 is an exploded assembly view thereof.
Figure 12:
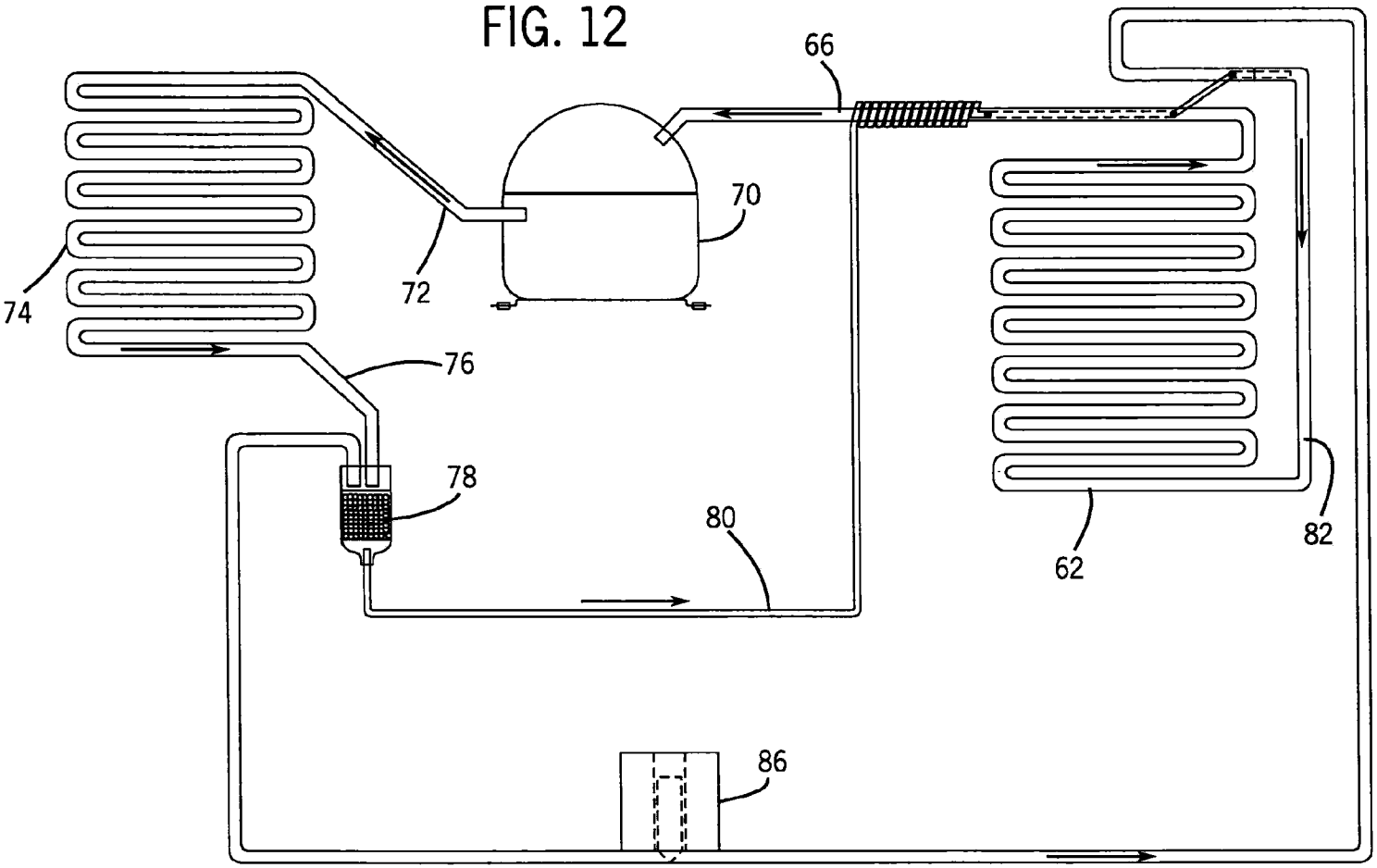
FIG. 12 is a diagram of the refrigeration system of the combination unit.

Along the back wall of the ice section 42 is an evaporator 62 with serpentine refrigerant tubes running through thin metal fins, which is part of the refrigeration system of the unit 30. With reference to FIGS. 4 and 12, the evaporator 62 has an outlet line 66 which is connected to the inlet of a compressor 70. A discharge line 72 connected to the outlet of the compressor 70 is connected to the inlet of a condenser 74 having an outlet line 76 connected to a dryer 78. A capillary tube 80 leads from the dryer 78 an inlet line 82 of the evaporator 62. A bypass line 84 leads from the dryer 78 to the inlet line 82 of the evaporator. A hot gas bypass valve 86 controls communication between the dryer 78 and the evaporator 62. Bypass valve 86 can be an electronically controlled solenoid type valve. An evaporator fan 89 is positioned near the evaporator 62 and a condenser fan (90) is positioned near the condenser 74. An evaporator pan 92 is positioned beneath the evaporator 62 and is configured to collect and drain water. An evaporator pan heater 94 is beneath the evaporator pan 92 to heat the evaporator pan 92. The compressor 70, condenser 74 and condenser fan (see FIG. 13) are located at the bottom of the cabinet 32 below the insulated portion.

Figure 5:
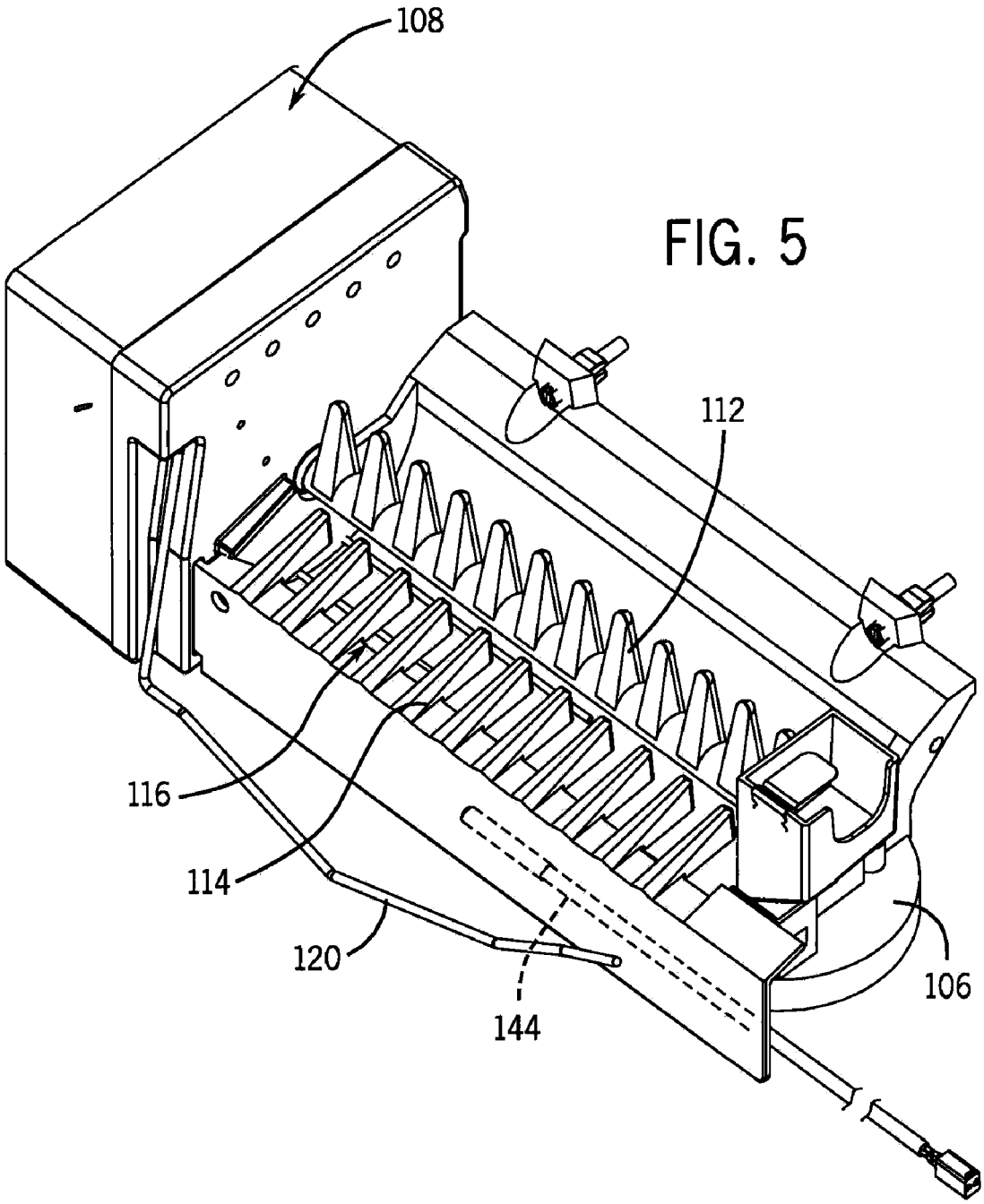
FIG. 5 is a perspective view of a cube ice maker assembly of the combination unit.
Figure 6:
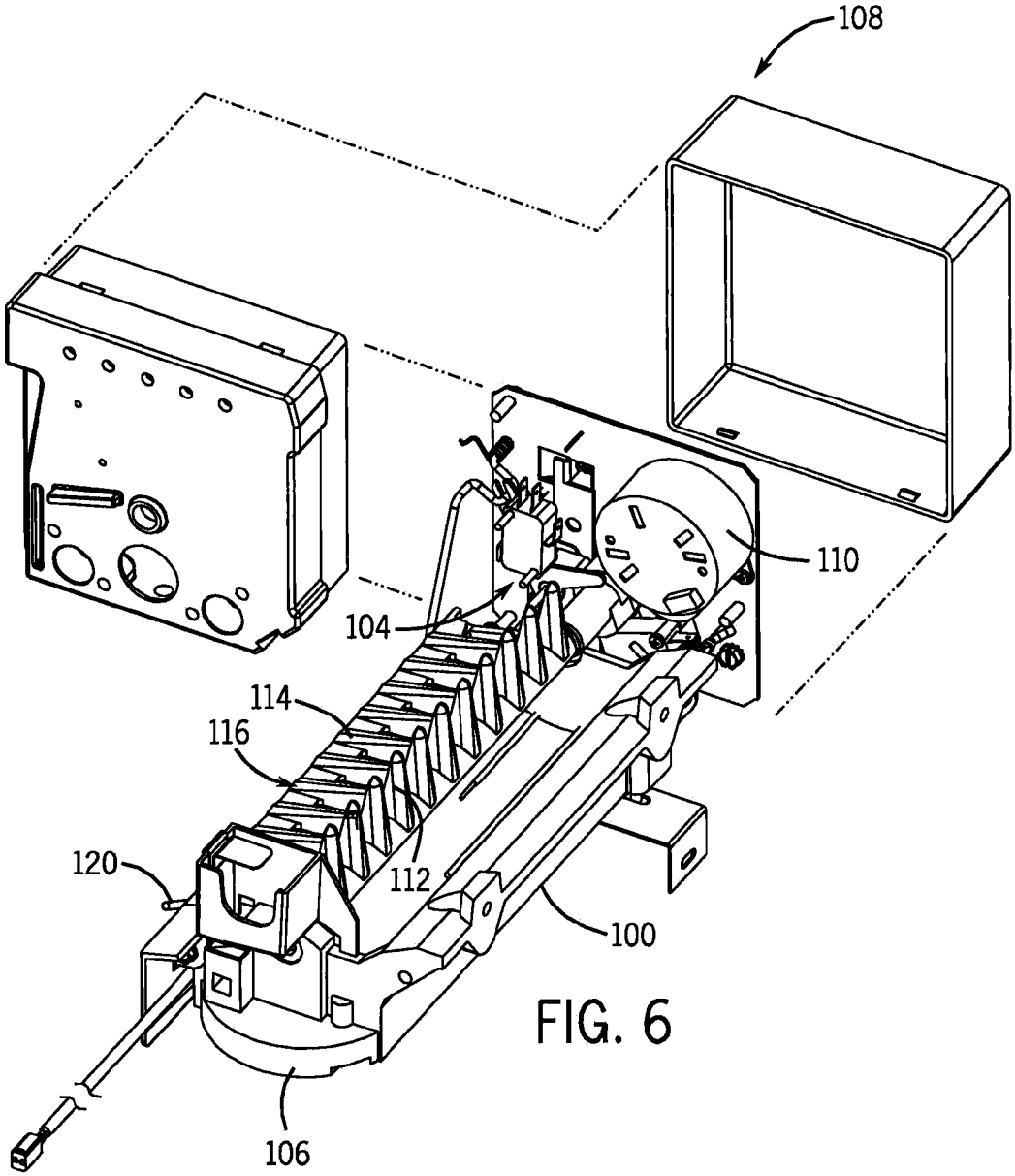
FIG. 6 is an exploded perspective view of the ice maker assembly.

Referring now to FIGS. 4-6, the cube ice maker assembly 56 is positioned in the upper part of the ice section 42 of the cabinet 32. The ice storage bin 58 is positioned in the lower part of the ice section 42 of the cabinet 32. The cube ice maker assembly 56 includes a housing 100, water inlet (not shown), drive assembly 104 and cube ice mold 106. The water inlet is connected to an electronic water valve 103 that controls the flow of water into the cube ice maker assembly 56. The water inlet is connected to a water transport mechanism (not shown) of the ice maker assembly 56 that transports water to the cavities of the cube ice mold 106 in order to fill the cube ice mold 106 with water when the electronic water valve 103 (see FIG. 13) is opened. The drive assembly 104 comprises a cover 108 that surrounds an electric motor 110. A plurality of ejector blades 112 are configured to be rotated by the electric motor 110 in order to engage ice formed in the cube ice mold 106 and carry the ice out of the cube ice mold 106, the ice stripped by a plurality of strippers 114 formed on a stripper plate 116, the ice dropping below into the ice storage bin 58. A mold heater 118 is in thermal communication with the cube ice mold 106 and is configured to provide heat to the cube ice mold 106 to loosen the ice from the cube ice mold 106 to aid the ejector blades 112 in ejecting the ice. A pivotably mounted ice level sensing arm 120 extends downwardly above the ice storage bin 58 to sense the level of the ice in the ice storage bin 58. Switches or sensors can be used to detect the position of the ejector blades 112 and/or motor 110 as well as the state of the cube ice maker assembly 56 (e.g., water fill, freeze and harvest stages).

Figure 13:
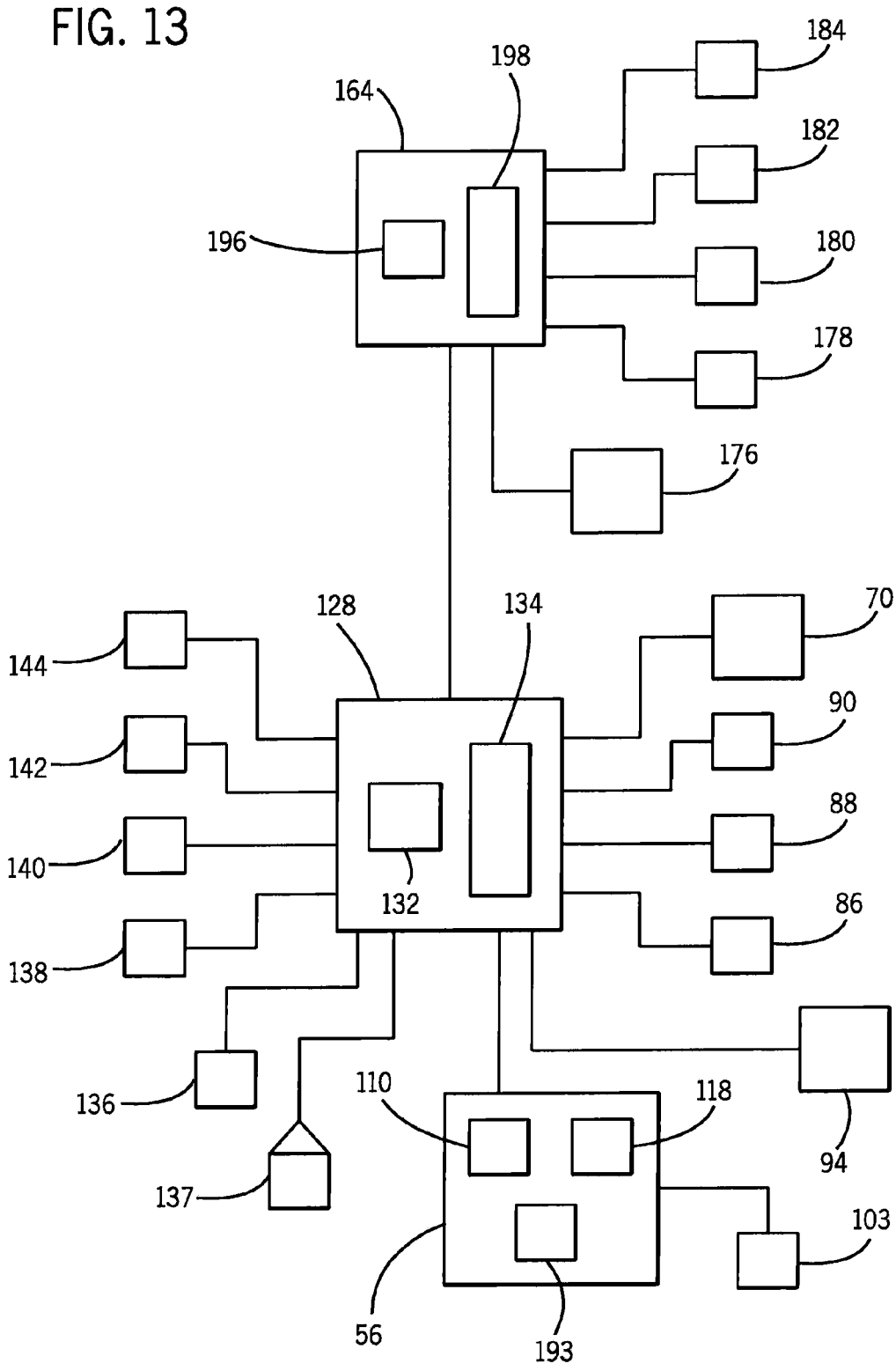
FIG. 13 is a block diagram of control system of the combination unit.

Referring now to FIGS. 4 and 13, a controller 128 is attached below the cabinet and adjacent a kickplate 130 positioned below the cabinet door 64. The controller 128 comprises a microprocessor 132 that is connected to a memory 134. Alternatively, the microprocessor can include a memory. A plurality of connectors and lines (not shown) connect the controller 128 to sensors (discussed below) and relays associated with the other electrical components (not shown) of the refrigeration unit 30. A door sensor 136 is connected to the cabinet 32 adjacent to the door 64, the door sensor 136 configured to sense if the door 64 is opened or closed and to signal to the controller 128 whether the door 64 is opened or closed. The door sensor 136 can comprise a reed switch that senses a magnet (not shown) mounted on the door 64. A light 137 is mounted within the refrigerator section 40, the light 137 activated when the door sensor 136 senses that the door 64 is open. A refrigerator section temperature sensor 138 is attached to refrigerator section 40 (see FIGS. 3 and 4) and senses the temperature of refrigerator section and provides refrigerator section temperature information to the controller 128. An ice section temperature sensor 140 is attached to the ice section 42 (see FIGS. 3 and 4) and senses the temperature of the ice section 42 and provides ice section temperature information to the controller 128. An evaporator pan temperature sensor 142 is attached to the evaporator pan 92 (see FIG. 4) and senses the temperature of the evaporator pan 92 and provides evaporator pan temperature information to the controller 128. A cube ice mold temperature sensor 144 (see FIG. 5) is positioned within the cube ice mold 106 to measure the temperature of the cube ice mold 106 at a position adjacent to a cavity of the cube ice mold 106 where the ice is formed, the cube ice mold temperature sensor 144 providing cube ice mold temperature information to the controller 128 and/or to the cube ice maker assembly 56. The temperature sensors 138, 140, 142, and 144 can comprise thermistors or other appropriate temperature sensors. The controller 128 is configured to control refrigeration, ice making, defrost and other aspects of the refrigeration unit 30 as will be described hereinafter. The controller 128 is also configured to monitor data relating to the operation of the refrigeration unit 30 and to log the data in the controller memory 134 for access by a service technician as discussed hereinafter. The logged data can include error codes.

As is known, the compressor 70 draws refrigerant from the evaporator 62 and discharges the refrigerant under increased pressure and temperature to the condenser 74. The hot, pre-condensed refrigerant gas entering the condenser 74 is cooled by air circulated by the condenser fan 90. As the temperature of the refrigerant drops under substantially constant pressure, the refrigerant in the condenser 74 liquefies. The smaller diameter capillary tube 80 maintains the high pressure in the condenser 74 and at the compressor outlet while providing substantially reduced pressure in the evaporator 62. The substantially reduced pressure in the evaporator 62 results in a large temperature drop and subsequent absorption of heat by the evaporator 62. The evaporator fan 89 can draw air from inside the ice section 42 across the evaporator 62, the cooled air returning to the ice section 42 to cool the ice section 42. At least one air passage (not shown) connects the ice section 42 and the refrigerator section 40 so that the refrigerator section 40 is cooled by the ice section 42, the temperature of the refrigerator section 40 related to the temperature of the ice section 42. The compressor 70, condenser fan 90 and evaporator fan 89 are controlled by the controller 128 to maintain the ice section 42 at an ice section setpoint. The ice section setpoint is based on a refrigerator section setpoint (e.g., ice section setpoint is minus 30° Fahrenheit of the refrigerator section setpoint), the refrigerator section setpoint being inputted by a user as described below. The controller 128 logs the compressor runtime between defrost cycles and stores the compressor runtime in the controller memory 134.

As mentioned, the refrigeration system includes a hot gas bypass valve 86 disposed in bypass line 84 between the dryer 78 and the evaporator inlet line 82. Hot gas bypass valve 86 is controlled by controller 128. The evaporator 62 is defrosted for a defrost time up to a maximum defrost time after a certain amount of compressor runtime. When the hot gas bypass valve 86 is opened, hot pre-condensed refrigerant will enter the evaporator 62, thereby heating the evaporator 62 and defrosting any ice buildup on the evaporator 62. The evaporator pan heater 94 heats the evaporator pan 92 when the hot gas bypass valve 86 is opened so that ice in the evaporator pan 92 is melted at the same time that the evaporator 62 is defrosted. The hot gas bypass valve 86 and evaporator pan heater 94 are controlled by the controller 128 (i.e., the defrost cycle is controlled by the controller 128). The controller 128 logs the defrost runtime and stores the defrost runtime in the controller memory 134. The interval between defrost cycles can be adjusted by the controller 128.

The controller 128 can initiate an ice making cycle of the cube ice maker assembly 56 if the ice level sensing arm 120 does not prevent an ice making cycle from being initiated. Alternatively, the cube ice maker assembly 56 can initiate the ice making cycle if so authorized by the controller 128 and if the ice level sensing arm 120 does not prevent an ice making cycle from being initiated. The cube ice maker assembly 56 includes a microcontroller 193 that controls the operation of the ice maker assembly 56. The ice making cycle begins with filling of the cube ice mold 106 with water. The cube ice mold 106 can be heated by the mold heater 118 before water filling. The microcontroller 193 opens the water valve 103 thereby filling the cube ice mold 106 with an appropriate amount of water and then shuts off the water valve 103. The water is then frozen into cubes. The temperature of the cube ice mold temperature sensor 144 is monitored by the controller 128, the controller 128 initiating ice harvest when an ice mold temperature setpoint is reached (i.e., 15° Fahrenheit). Alternatively, the microcontroller 193 could monitor the temperature of the cube ice mold 106 and decide when to initiate ice harvest. During ice harvest, the microcontroller 193 causes the mold heater 118 (see FIG. 13) to heat the cube ice mold 106 and causes the ejector blades 112 to rotate thereby pushing the ice out of the cube ice mold 106 and into the ice storage bin 58. Limit switches can monitor when the ejector blades 112 have fully rotated so that another ice making cycle can be initiated if the ice level sensing arm 120 does not sense that the ice storage bin 58 is full of ice. The compressor 70 can be on or off during the freezing and harvest stages of the ice making cycle and should be off during the water fill stage.

Figure 7:
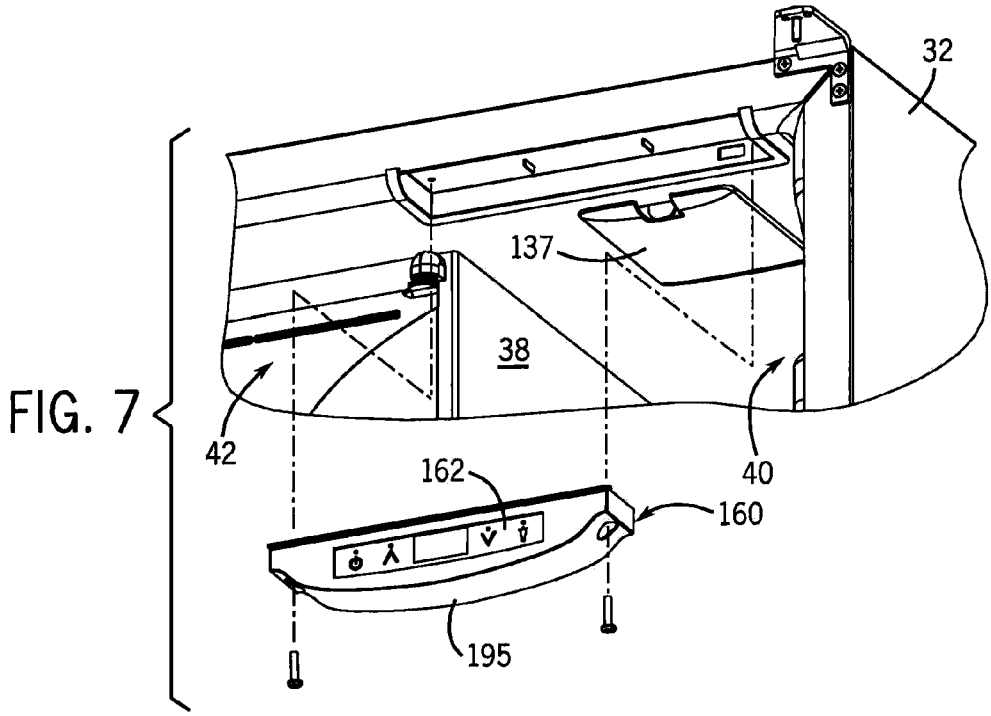
FIG. 7 is a partial exploded perspective view showing the user interface control unit.
Figure 8:
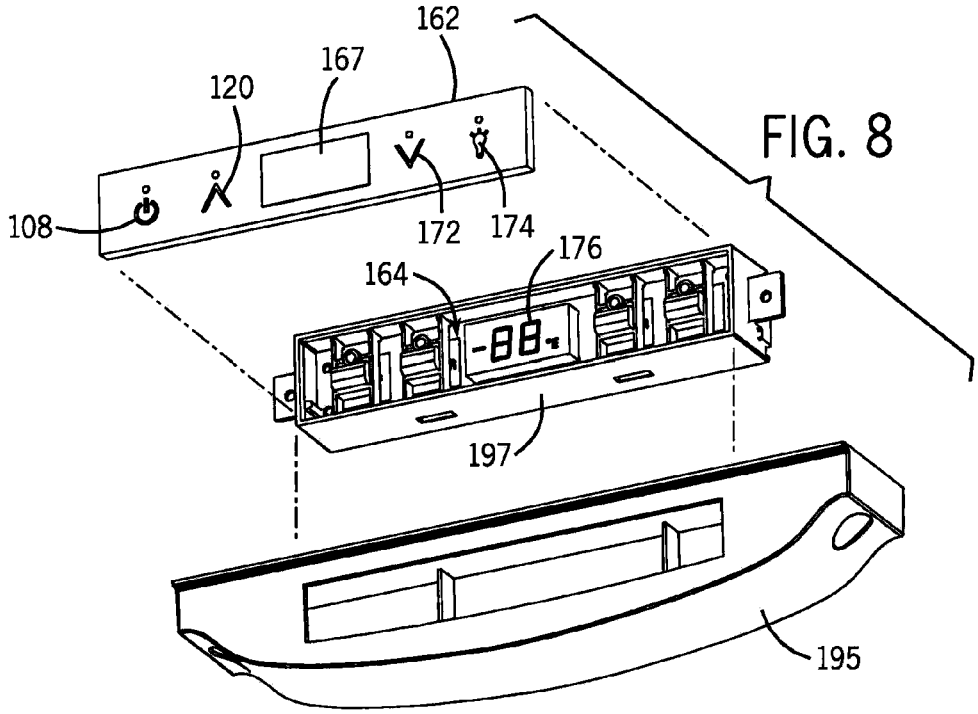
FIG. 8 is an exploded assembly of the user interface control unit.
Figure 10:
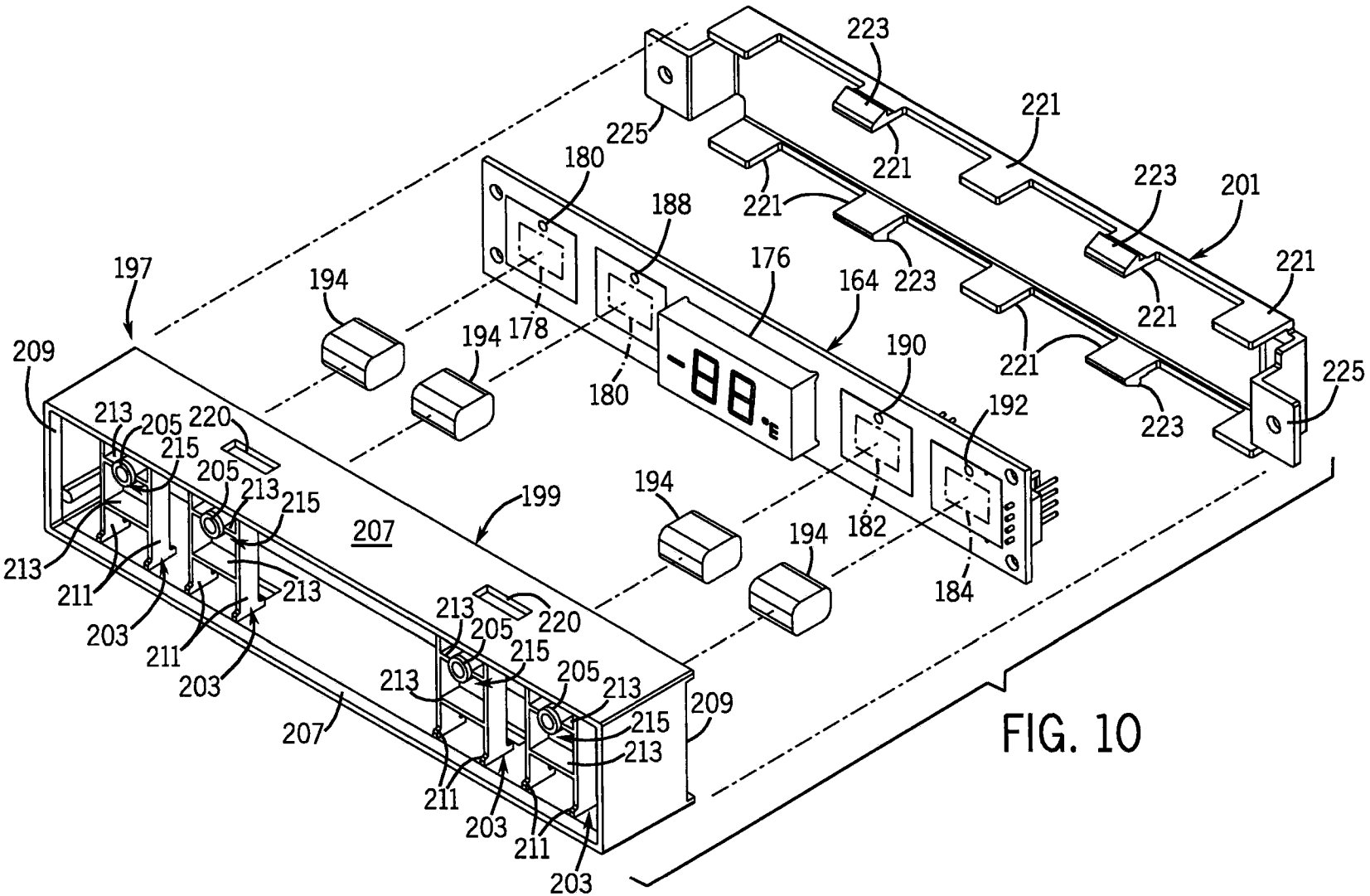
FIG. 10 is an exploded perspective view of the control board and mount.

Referring now to FIG. 7, a user interface control unit 160 is mounted to the top of the refrigerator molded insert liner 44 within the cabinet 32 for receiving user commands and forwarding input signals to the main controller 128. The control unit 160 includes a display panel 162 and an input control board 164. The display panel 162 has a translucent display window 167, having power indicia 168, a warmer indicia 170, a cooler indicia 172 and a light indicia 174. The control board 164 includes an electronic display 176, a power switch 178, a warmer switch 180, a cooler switch 182, a light switch 184 and a plurality of LEDs 186, 188, 190, and 192, associated with the switches, respectively. The display panel window 166 is positioned in front of the display 176 on the control board 164 and allows for a user to view whatever is displayed on the display 176. The power indicia 168, warmer indicia 170, cooler indicia 172 and light indicia 174 are positioned in front of the power switch 178, warmer switch 180, cooler switch 182, and light switch 184, respectively. The switches 178, 180, 182, and 184 comprise capacitive proximity sensors which include flexible extension pads 194 positioned adjacent the corresponding indicia 168, 170, 172, and 174. The pads 194 are preferably adhered to the conductive contacts of the switches on the control board 164 and touch against the back side of the display panel 162. The pads 194 are made of foam cores encased in conductive fabric that provides an electrical pathway from the switch contact on the control board 164 to the display panel 162.

Referring to FIGS. 8-11, the display panel 162 and the control board 164 are mounted inside of an outer control housing 195 via mount 197. The mount 197 has two parts, a main housing 199 and a back cover 201. The housing 199 is a monolithic structure formed of a molded plastic to include a plurality of integral switch supports 203 and light guides 205 as a single unitary part, four of each are shown. The housing has pairs of long 207 and short 209 outer walls that form the perimeter of the mount 197 framing the control board 164. The long walls 207 have two slots 220 therein for attaching the back cover 201. The switch supports 203 span the long walls 207 with their two spaced apart bridge walls 211 across which extend two spaced apart cross walls 213. The intersection of these walls 211 and 213 form a generally square opening 215 which surrounds each flexible extension pad 194 to restrain it from excessive lateral movement that could cause it to lose contact with the control board 164 and the display panel 162. The light guides 205 are cylindrical walls that intersect the upper cross wall of each switch support 203.

While the disclosed embodiment shows square openings 215 and cylindrical light guides 205 other suitable configurations could be used provided the extension pads 194 are adequately supported at their sides and light from the LEDs 186, 188, 190 and 192 is effectively isolated from the interior of the housing 199 and directed from the control board 164 to the associated indicia of the display panel 162 to illuminate the indicia.

The outer side of the switch supports 203 and light guides 205 are generally co-planar and recessed back from the front plane of the housing 199 so that the display panel 162 can be recess mounted inside the front opening for the housing 199 and by supported at its back side by the switch supports 203 and the light guides 205. The back side of the switch supports 203 extend to a plane that extends into the housing 199 a lesser distance than does the back side of the light guides 205. This helps ensure that the light guides 205 extend down against the control board 164 to better surround the LEDs 186, 188, 190 and 192 to prevent light from leaking around the light guides 205.

The control board 164 is secured into the housing 199 by tabs 221 on the back cover 201 that extend into the housing 199 and contact the back side of the control board 164 to apply a clamping force holding the control board 164 against the light guides 205, thus securing the position of the control board 164 and further reducing the chance of light leaking around the light guides 205. Four of the tabs 221 have catches 223 that engage the slots 220 in the long walls 207 of the housing 199 to attach the back cover 201. The back cover 201 also has two ears 225 with openings therein that provide for mounting of the mount to a support surface, such as the outer control housing 195. The display panel 162 is secured within the housing 199 by abutment with the front wall of the outer control housing 195.

The switches 178, 180, 182 and 184 are each configured to independently sense when they are activated by a user. In order to simplify discussion of the operation of the switches 178, 180, 182 and 184, activation of a switch will be described as touching and/or holding of the indicia on the display panel 162 associated with one of the switches 178, 180, 182 and 184 which is then activated by a change in capacitance, or upon reaching a certain threshold level of capacitance.

The control board 164 further includes an input processor 196 connected to the controller 128 and to the display 176; switches 178, 180, 182, and 184; and LEDs 186, 188, 190, and 192. The input processor 196 is connected to a memory 198. Alternatively, the input processor 196 can include a memory. The input processor 196 receives signals from the switches 178, 180, 182 and 184 when the switches 178, 180, 182 and 184 are touched. Additionally, when one of the switches 178, 180, 182, and 184 is touched, the corresponding LED 186, 188, 190, or 192 is lit and a beep sound is produced by at least one sound component (not shown) mounted to the controller 128 and/or control unit 160. The input processor 196 is connected to the controller 128 and the controller 128 controls what is displayed on display 176.

The input processor 196 receives a power signal 200, a warmer signal 202, a cooler signal 204, and a light signal 206 when switches 178, 180, 182 and 184, respectively, are touched and/or held. The input processor 196 can determine if the switches 178, 180, 182 and 184 are touched or held, and can determine the length of the hold. The input processor 196 analyzes a sequence and/or combination of signals 200, 202, 204, and 206 as a coded input 208. The input processor 196 decodes the coded input 208 and provides an input command 210 to the controller 128. The input processor memory 198 includes the coded inputs 208. The controller 128 then performs a controller operation corresponding to the input command 210. The controller operations and input commands 210 are stored in the controller memory 134.

FIG. 14 shows coded inputs 208 and their corresponding input commands 210. Note that the input commands include commands for cooling units including various combinations of at least one refrigerator section, a cube ice maker, a clear ice maker, and a freezer section. Holding the power switch 178 for ten seconds corresponds to a power command that will cause the display to turn on and off. Touching the light switch 184 one time corresponds to a light toggle command that causes the light mode to be toggled (i.e., light 137 on/off when a glass door is open/closed or light 137 on all the time). Holding the warmer switch 180 for five seconds corresponds to a view actual temperature of the temperature sensor 138 command that causes the actual temperature of the temperature sensor 138 being displayed on display 176. Holding both the warmer switch 180 and the cooler switch 182 corresponds to a view actual temperature of the other temperature sensors command that results in the actual temperature of the temperatures sensors 140, 142 and 144 being scrolled on the display 176. Holding the light switch 184 while touching the cooler switch 182 three times corresponds to a toggle temperature units command that results in toggling the temperature units used (i.e., Celsius or Fahrenheit). Holding the cooler switch 182 while touching the light switch 184 three times corresponds to a turn showroom mode on command that results in enabling the showroom mode. Holding the warmer switch 180 while touching the power switch 178 three times causes the display mode to be toggled (i.e., display 176 and/or LEDs 186, 188, 190, or 192 on/off when a glass door is open/closed). Holding the light switch 184 for ten seconds corresponds to a blackout mode command that results in light 137, display 176, and LEDs 186, 188, 190, or 192 being turned off for 36 hours or until light switch 184 is again held for ten seconds. Holding the power switch 178 while touching the light switch 184 three times corresponds to a cleaning mode command the results in running the cleaning mode for cooling units with clear ice cube makers. Holding power switch 178 while touching the warmer switch 180 three times corresponds to a icemaker on/off command that results in turning the ice maker assembly 56 on and off.

Holding the power switch 178 while touching the cool switch 182 corresponds to a forced harvest command that results in a forced harvest of the ice in the ice maker assembly 56. Holding the light switch 184 while touching the power switch 178 three times corresponds to a forced defrost command that results in a forced defrost of the refrigeration system. Holding the cooler switch 182 while touching the warmer switch 180 three times corresponds to a temporary shutdown command that results in a temporary shutdown of the cooling unit 30 for three hours. Holding the cooler switch 182 while touching the power switch 178 three times corresponds to a relay status command that results in the status of the relays being scrolled on the display 176 (i.e., single digit relay number and 1/0 for on/off).

Depending on the input command 210, after an input command 210 has been sent to the controller 128 the input processor 196 can wait for further signals from the switches 178, 180, 182 and 184 and then decode or directly send a corresponding further input command the controller 128. For example, once an input command 210 has been sent to the controller 128, touching the temperature adjustment switches 180 and 182 can scroll though a displayed menu of menu options and touching the light switch 184 can select the menu option currently displayed (i.e., the light switch 184 acts as a return or enter key). Holding the warmer switch 180 while touching the light switch 184 three times corresponds to a service mode command which results in a service mode menu list to be displayed on the display 176 as discussed below. Touching one of the temperature adjustment switches 180 and 182 corresponds to a cooling unit setpoint set mode command that causes the input processor 196 to send temperature adjustment command signals to the controller 128 when the temperature adjustment switches 180 and 182 are touched thereafter so that the refrigerator unit setpoint can set by a user by scrolling to a setpoint and selecting the setpoint. Holding the warmer switch 180 while touching the cooler switch 182 corresponds to an ice thickness adjustment command that allows for an ice thickness of clear ice to be selected by scrolling to an ice thickness and selecting the ice thickness. Holding each of the warmer switch 180, cooler switch 182, and light switch 184 while a jumper (not shown) is placed on the controller 128 corresponds to a change model number command that allows for changing the model number by selecting a model scrolled on the display 176.

The service mode input command causes the controller 128 to execute a service mode operation that causes the display of service mode menu options on the display 176. Examples of service mode menu options are summarized in TABLE 1 below.

TABLE 1

Service Mode Menu Options

| Option Number | Description |
|---|---|
| 1 | Light all LED Segments |
| 2 | Temperature sensor #1 status (Temp, E1 or E2) |
| 3 | Error log |
| 4 | Defrost info |
| 5 | Compressor runtime (based on last cycle) |
| 6 | Defrost Length (adjustment - up to 99 minutes |
| 7 | Light switch status (0 or 1) |
| 8 | Display toggle status (0 or 1) |
| 9 | Restore factory defaults |
| 10 | Adjust temperature sensor #1 offset (−10 to +10) |
| 11 | Data download |
| 12 | Clear error log |
| 13 | Clear download memory |

TABLE 1-continued

Service Mode Menu Options

| Option Number | Description |
|---|---|
| 14 | Model number display |
| 15 | Adjust temperature sensor #1 differential |
| 16 | Adjust temperature sensor #2 offset |
| 17 | Adjust temperature sensor #3 offset |
| 18 | Adjust temperature sensor #4 offset |
| 19 | View temperature sensor #2 status |
| 20 | View temperature sensor #3 status |
| 21 | View temperature sensor #4 status |
| 22 | Automatic toggle through relays (switch on or off) |
| 23 | Defrost interval adjust (3 to 24 hours) |
| 24 | Adjust temperature sensor #2 setpoint |
| 25 | Adjust temperature sensor #3 setpoint |
| 26 | Adjust temperature sensor #4 setpoint |
| 27 | Display software version |
| 99 | Exit Service Mode |

A service technician can scroll through the service menu option numbers by touching temperature adjustment switches 180 and 182 and select the option displayed in the display 176 by touching the light switch 184. The service technician can select a service mode menu option that will result in the display of cooling unit operational data that has been logged by the controller 128 (e.g. temperature sensor status/temperature, defrost information, compressor runtime, light switch status). The operational data is sensed by sensors and/or the controller 128 and logged by the controller 128 in the controller memory 134. Other service menu options will result in the controller 128 performing a function (e.g., light all LEDs, restore factory defaults, clear error log, clear download memory, and automatic toggle through relays). Additionally, the selected service mode menu option may require further input from the service technician, and the service technician can touch and/or hold the switches 178, 180, 182 and 184 to provide that input. For example, the service technician can select the defrost length service mode menu option and then set the length of the defrost cycle, which is saved into controller memory 134. The service technician can also adjust temperature sensor setpoints, offsets and differential.

The service technician can also select the error log service mode menu option and the error codes stored in the controller memory 134 will be displayed on the display 176. The service technician may choose to view the error codes displayed in the memory because the controller 128 displays a generic error indicator (not shown) on the display 176 when an error has been detected and an error code logged. The generic error indicator does not indicate the specific error code (e.g., the generic error code can be "Er"). The service technician can scroll through the error codes from the most recent error code to the last error code by touching temperature adjustment switches 180 and 182. Alternatively, the error codes can be scrolled in sequence automatically by the controller 128. Examples of error codes are summarized below in TABLE 2. The summary of error codes includes error codes for cooling units including various combinations of at least one refrigerator section, a cube ice maker, a clear ice maker, and a freezer section.

TABLE 2

| Error Code | Description |
|---|---|
| E1 | Temperature Sensor #1 open |
| E2 | Temperature Sensor #1 shorted |

TABLE 2-continued

| Error Code | Description |
|---|---|
| E3 | Door #1 open longer than 20 minutes |
| E5 | Temperature Sensor #1 out of range (+10) for more than 12 hours |
| E6 | Temperature Sensor #1 out of range (−10) for more than 12 hours |
| E7 | Temperature Sensor #2 open or shorted |
| E8 | Temperature Sensor #3 open or shorted |
| E9 | Temperature Sensor #4 open or shorted |
| E10 | Door #2 (drawer) open longer than 20 minutes |
| E11 | EE Memory Error |
| P1 | Pump circuit open due to high water level in ice bin |

The service technician can view the error code displayed on the display 176 and determine the corresponding error. The error codes are generated by controller 128 when an error condition has been detected. The error conditions are stored in the controller memory 134. One error code is a door open error code that is detected and logged when the controller 128 determines that the door 64 has been open for longer than a period of time stored in memory (e.g., twenty minutes), the controller 128 also producing an error message on the display 176 and generating an audible alert. Other error codes relate to the temperature sensors 138, 140, 142, and 144, the controller 128 monitoring and storing error codes when a temperature sensor is open, shorted, or out of range for a period of time. Other components of the cooling unit 30 can be monitored by the controller 128 and error codes can be logged by the controller 128 when an error has been detected.

The controller 128 can include a connector (not shown) to which a service technician can connect a computer. The functions of the controller 128 can be accessed through the computer and the computer can download the data logged by the controller 128.

It should be appreciated that merely a preferred embodiment of the invention has been described above. However, many modifications and variations to the preferred embodiment will be apparent to those skilled in the art, which will be within the spirit and scope of the invention. Therefore, the invention should not be limited to the described embodiment. To ascertain the full scope of the invention, the following claims should be referenced.

We claim:

1. A mount for an electronic control having a display panel and a control board with an LED and a switch having a flexible extension extending to the display panel, the mount comprising:

a housing for containing the board, the housing having two sets of spaced apart opposite walls extending about the board and defining an open side opening to the display panel;

a switch support disposed in the housing so as to laterally restrain the flexible extension, wherein the switch support includes a pair of bridge walls extending between a first of the two sets of opposite walls of the housing and includes a pair of cross walls extending between the bridge walls so as to define an opening therebetween bounded by the bridge and cross wall; and a light guide disposed in the housing so as to be adjacent the LED and direct light from the LED to the display panel, wherein the light guide is a cylindrical wall that intersects one of the cross walls.

2. The mount of claim 1, wherein there are plurality of switch supports each being disposed in the housing in association with a plurality of switches of the control board.

3. The mount of claim 1, wherein the bridge walls are essentially parallel to each other and essentially perpendicular to the cross walls.

4. The mount of claim 1, wherein there are plurality of light guides each being disposed in the housing in association with a plurality of LEDs of the control board.

5. The mount of claim 1, wherein the light guide is cylindrical.

6. The mount of claim 1, wherein the housing, switch support and light guide are an integral part of a monolithic structure.

7. The mount of claim 1, further including a back cover removeably connected to the housing.

8. The mount of claim 7, wherein the back cover clamps the control board against at least one of the switch support and the light guide.

9. The mount of claim 8, wherein the back cover includes at least one tab extending inside the housing.

10. The mount of claim 9, wherein the back cover connects to the housing via a tab and slot connection.

11. The mount of claim 7, wherein one of the housing and the back cover including mounting tabs for securing the mount to a mounting surface.

12. A mount for an electronic control having a display panel and a control board with an LED and a switch having a flexible extension extending to the display panel, the mount comprising:

a housing for containing the board, the housing having two sets of spaced apart opposite walls extending about the board and defining an open side opening to the display panel;

a switch support disposed in the housing so as to laterally restrain the flexible extension; and a light guide disposed in the housing so as to be adjacent the LED and direct light from the LED to the display panel;

wherein the housing walls extend to a first plane at the open side of the housing and the switch support and the light guide extend to a second plane recessed within the housing from the first plane, and wherein the switch support extends between the second plane and a third plane and wherein the light guide extends between the second plane and a fourth plane spaced from the second plane a greater distance than the third plane.

13. A mount for an electronic control having a display panel and a control board with an LED and a switch having a flexible extension extending to the display panel, the mount comprising:

a housing for containing the board, the housing having two sets of spaced apart opposite walls defining a closed perimeter extending about the board, the housing having an open side opening to the display panel;

a switch support having at least one wall disposed in the housing so as to be adjacent and laterally restrain the flexible extension of the switch, wherein the switch support includes a pair of bridge walls extending between two outer walls of the mount and a pair of cross walls connected to the bridge walls; and a light guide having an open ended annular wall intersecting one of the cross walls to direct light from the LED to the display panel;

wherein the housing, switch support and light guide are an integral part of a monolithic structure.

14. The mount of claim 13, wherein there are a plurality of switch supports and a plurality of light guides each corresponding to an associated one of a plurality of switches and LEDs on the control board.

15. The mount of claim 13, further including a back cover that removeably connects to the housing and clamps the control board against at least one of the switch support and the light guide.

16. A control assembly, comprising:

a display panel;

a control board having an LED and a switch;

a flexible extension extending between the switch and the display panel; and a mount supporting the display panel and the control board and having a switch support laterally restraining the flexible extension and an open ended light guide directing light from the LED to the display panel wherein the switch support includes a pair of bridge walls extending between two outer walls of the mount and includes a pair of cross walls extending between the bridge walls so as to define an opening therebetween bounded by the bridge and cross walls, and wherein the light guide is a cylindrical wall that intersects one of the cross walls.

17. The assembly of claim 16, wherein there are plurality of switch sensors and flexible extensions and a plurality of associated switch supports.

18. The assembly of claim 16, wherein there are plurality of LEDs and a plurality of associated light guides.

19. The assembly of claim 16, wherein the mount is a monolithic structure having the switch support and light guide as a unitary part thereof.

20. The assembly of claim 16, wherein the mount further includes a removable back cover that clamps the control board against at least one of the switch support and the light guide.

* * * * *